US006811840B1

(12) United States Patent
Cross

(10) Patent No.: US 6,811,840 B1
(45) Date of Patent: Nov. 2, 2004

(54) DECORATIVE TRANSFER PROCESS

(75) Inventor: Kyle Glenn Cross, New Baltimore, MI (US)

(73) Assignee: Stahls' Inc., St. Clair Shores, MI (US)

( * ) Notice: Subject to any disclaimer, the term of this patent is extended or adjusted under 35 U.S.C. 154(b) by 54 days.

(21) Appl. No.: 09/910,966

(22) Filed: Jul. 23, 2001

Related U.S. Application Data

(63) Continuation of application No. 08/605,923, filed on Feb. 23, 1996, now abandoned.

(51) Int. Cl.[7] ..... B41M 5/40
(52) U.S. Cl. ..... 428/32.62; 428/32.81
(58) Field of Search ..... 428/32.62, 32.81, 428/195, 200, 352

(56) References Cited

U.S. PATENT DOCUMENTS

| | | | | |
|---|---|---|---|---|
| 3,562,087 A | | 2/1971 | Wigzell | |
| 4,066,802 A | | 1/1978 | Clemens | |
| 4,735,854 A | | 4/1988 | Lauchenauer | |
| 4,773,953 A | | 9/1988 | Hare | |
| 4,786,349 A | * | 11/1988 | Mahn, Sr. | 156/234 |
| 4,863,781 A | * | 9/1989 | Kronzer | 428/200 |
| 5,196,080 A | | 3/1993 | Mizobuchi et al. | |
| 5,243,032 A | | 9/1993 | Rieper | |
| 5,483,321 A | | 1/1996 | Cahill et al. | |
| 5,543,177 A | | 8/1996 | Morrison et al. | |
| 5,556,693 A | | 9/1996 | Yamane et al. | |
| 5,575,877 A | | 11/1996 | Hale et al. | |
| 5,695,855 A | * | 12/1997 | Yeo et al. | 428/196 |
| 6,482,285 B2 | * | 11/2002 | Cross | 156/230 |

FOREIGN PATENT DOCUMENTS

GB 2 189 436 A * 10/1987

* cited by examiner

*Primary Examiner*—B. Shewareged
(74) *Attorney, Agent, or Firm*—Brooks Kushman P.C.

(57) ABSTRACT

Transfers, suitable for applying complex designs to articles by the application of heat and pressure, are prepared simply and economically by printing the design onto plain paper or other fusible polymer-free substrate from a conventional ink-jet printer. The avoidance of polymer-coated paper allows the design to be transferred to fabric articles without altering the hand and feel of fabric in non-printed areas without the necessity of cutting the transfer from the substrate.

5 Claims, 1 Drawing Sheet

DECORATIVE TRANSFER PROCESS

A continuation application under 37 C.F.R. §1.53(b) of prior application Ser. No. 08/605,923 filed on Feb. 23,1996, now abandoned entitled DECORATIVE TRANSFER PROCESS

TECHNICAL FIELD

The present invention pertains to the field of transfer printing. More particularly, the subject invention pertains to a process for transfer printing suitable for application to fabrics and other substrates without the use of a polymer coated paper support.

BACKGROUND OF THE INVENTION

The use of transfer printing to produce signs, lettering, and particularly customized clothing and other textile articles is well known. In the traditional method of transfer printing, a single or multicolor "transfer" is prepared by silk screen printing onto an appropriate release substrate. The release substrate may be coated with a polymer adhesive prior to printing the image to be printed, or the print ink itself may contain a polymer adhesive, generally a thermoplastic composition with a melting point below that of the substrate onto which the transfer is to be printed. Alternatively, the printing process may be followed by a second printing wherein adhesive, rather than ink is applied, or the entire transfer may be sprayed with adhesive.

Transfers have also been prepared using pigmented films of carboxylated polyvinylchloride which are cast onto a polyester release sheet following which a thermally activated adhesive is applied. A graphic design is "kiss-cut" in reverse through the pigmented carboxylated PVC and adhesive layers but not through the polyester release sheet. After unwanted portions are weeded away, the transfer is applied to the fabric or garment in a heated press, allowed to cool, and the release sheet pulled away, leaving the graphic design adhered to the fabric or garment. This process requires a relatively expensive computer-guided cutting apparatus, and is generally limited to monochrome transfers.

In order to form multi-colored transfers by a conventional process, a separate silk screen must be prepared for each of the primary colors, and if a white area is to be printed, a white pigmented ink must also be applied in a separate printing step. The use of the silk screening process is labor intensive, as the registration of second and subsequent silk screens must closely match that of the first, otherwise an off-register transfer will be produced. Following preparation of the transfer, a computer guided cutting machine accurately cuts around the periphery of the transfer to avoid impregnation of the substrate to be printed with non-functional polymeric material which may detract from the hand and feel of the fabric. Furthermore, the traditional silk screening process is not amenable to the production of transfers of highly detailed subjects, such as those which might be obtained from photographs or computer graphics programs.

Several alternatives to silk screening of transfers are commercially available. In the full color true sublimation transfer process, an impact printer or thermal ribbon printer is used to print a sublimation dye onto a substrate. For full color rendition, a three-head printer must be used or the substrate given multiple passes through a printer after changing color heads. Registration problems may occur during the process, and the resolution is affected by the dot density of the impact or thermal head. The transfer thus created is placed onto the desired article, for example, a T-shirt, cap, or sweatshirt, and heated under modest pressure, during which the dyes coated on the transfer sublime and penetrate the fabric, producing a dyed article. This process is an improvement over silk screening in the sense that it is particularly amenable to computer graphics use, and moreover, the absence of polymer adhesive, particularly in areas surrounding the image, does not alter the hand or feel of fabric.

A related process is the dye sublimation transfer process. In this process, the sublimation dye is first sublimed onto the transfer substrate, and then sublimed a second time onto the desired article. The dye sublimation process affords higher resolution than the full color true sublimation process, however, the colors tend to be less vibrant due to the double sublimation. Higher pressure is also necessary during application, and thus the process is highly suitable for producing customized items such as coffee mugs.

Both the full color true sublimation and dye sublimation processes also suffer from the inability to dye certain substrates. Sublimation dyes are quite effective on polyester fabric or polyester blends, for example polyester/cotton. However cotton or polyester/cotton blends with low polyester content must in general be treated with a solution to enhance the dye penetration. Such processes add to the time and expense of garment preparation. Sublimation processes tend to be relatively expensive, and are generally used only for limited numbers of identical transfers, or where graphics quality is of paramount importance.

Color copiers have been used to produce full color transfers. In this process, a full color original is copied onto a special paper having a fusible polymer coating. The coating must have a fusion temperature higher than that used to set the toner particles from the printer, but less than the article to which they are to be applied. Full color copies of this type are expensive, and some have registration problems, as the same paper passes over multiple toner-apply and heat-set rollers. The use of special polymer coated paper increases the cost, and furthermore, the finished article will have the polymer coating impregnated over the entire corresponding surface unless the transfer is first cut along its periphery. Ink-jet color printers have been used in a manner analogous to color copiers, again using specially coated paper. Once more, the polymer coating is transferred along with the image, across the full width of the paper. However, color ink-jet printers are widely available at modest cost.

OBJECTS OF THE INVENTION

It is an object of the present invention to economically produce black and white and full color transfers.

It is a further object of the invention to produce black and white and full color transfers using inexpensive and widely available printing means.

It is a further object of the invention to produce black and white and full color transfers where the cutting of the transfer along the printed periphery is not necessary, and wherein the uncut transfer does not alter the hand and feel of fabric in non-printed areas.

SUMMARY OF THE INVENTION

These and other objects are achieved by a transfer printing process wherein a transfer printing ink is directly printed onto a substrate substantially free of fusible or heat-curable polymer with an ink-jet printer, and the resulting transfer is applied to an article under heat and pressure.

DESCRIPTION OF THE PREFERRED EMBODIMENT

Figure 1:
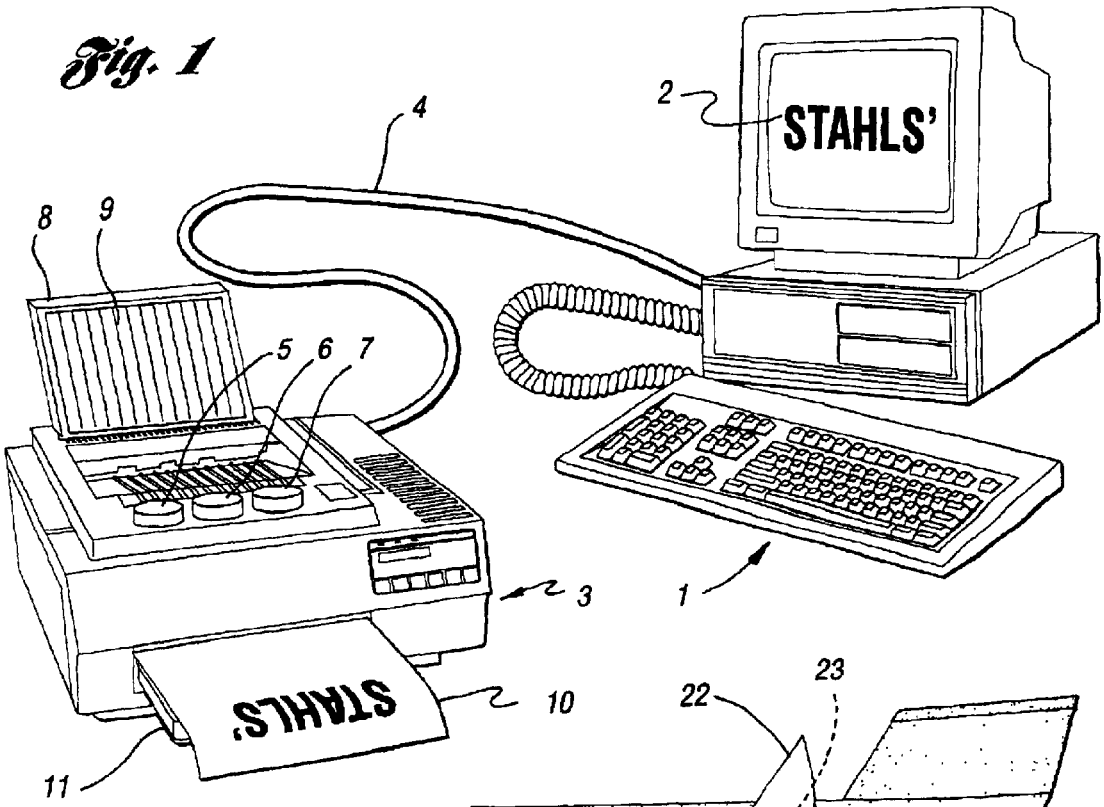
FIG. 1 illustrates the printing of a thermal transfer onto a substrate employing an ink-jet printer connected to a computer containing a computer-readable file corresponding to the printed design.

Ink-jet printers are well known and commercially available. Such printers may be divided into continuous, piezoelectric, and thermal/bubble jet subcategories. All are useful in the present invention.

Ink-jet technologies have evolved over the last two decades with continuous ink-jet being the first to be developed, followed by piezoelectric and then thermal or bubble-jet technologies. All three have been commercialized, although bubble-jet is the most popular today and continuous ink-jet is primarily for page printer or high-quality color graphics and image applications. Both piezoelectric and bubble-jet are "drop-on-demand" or "impulse" technologies, i.e., a drop is ejected from the printhead only when desired. With continuous ink-jet, a continuous stream of droplets is generated by the printhead and undesired drops are deflected electrostatically away from the paper (or vice versa.

With continuous ink-jet printing, ink is continuously jetted from a small-diameter nozzle under pressure. Although the resultant jet stream will naturally break into small drops, this phenomenon is assisted and stabilized by the inclusion of a piezoelectric perturbation transducer, driven at the desired drop rate. Operation at frequencies in excess of 100 kHz is possible with drop velocities of typically 25 m/s with a 50 $\mu$m nozzle diameter. Because the drops must be electrostatically charged at the breakoff point, conductive ink must be used. The ink source is typically grounded and a controllable voltage electrode is placed at the breakoff point (usually surrounding the jet stream). The charge level on each drop is then proportional to the applied voltage. Each charged drop can then be deflected by parallel downstream deflection plates with a field of typically 10 kV/cm.

Drop deflection can be either binary or analog. With the former, the drop either reaches the paper or is directed into a collection gutter. With analog deflection, the drop may be deflected linearly (e.g., any position over the height of a printed character). Smaller satellite drops may be also produced between the primary drops. To eliminate this effect, the excitation system is designed to produce forward-merging (through "drafting") and subsequent drop coalescence will not alter the charge-to-mass ratio of the augmented drop.

Compensation must be provided for both aerodynamic and electrostatic interactions. Two primary examples are that (1) the first drop in a sequence of drops encounters much greater aerodynamic drag than subsequent drops, and (2) the charge on a drop is influenced by the charge on the previous few drops. One approach to greatly reduce electrostatic drop interaction and to stabilize merging effects is to include noncharged drops between charged drops. This obviously reduces the effective drop rate by a factor of two and requires a design configuration where only charged drops reach the paper. Charging electrode voltage adjustment algorithms based on voltages applied to prior drops are also used to reduce the electrostatic interaction.

An alternate approach is the continuous spray design where a smaller nozzle (10–20 $\mu$m) is used. Much smaller drops are produced at higher velocities (≈40 m/s). It is often called the Hertz method. As with the continuous drop approach, a controlled voltage electrode is positioned around the breakoff point of the jet stream, a conductive ink is used, and the smaller droplets are charged proportionally to the applied voltage. The stream of droplets is directed to the paper when no voltage is applied. When a voltage is applied, the resulting electrostatic charge to the droplets produces strong mutual repulsion forces and the stream transforms into a spray, the cone angle of which is determined by the applied voltage. The spray is intercepted by a collecting surface surrounding the collection orifice which allows only uncharged or low-charged droplets through to the paper. With analog voltage control, the amount of spray that passes through the orifice can be varied, thus providing gray-scale capability. This approach (with multiple orifices) has been commercialized for very high-quality color image and graphics applications.

In piezoelectric ink-jet printing, piezoelectric ceramic transducers are employed with this technology. These materials (e.g. lead zirconate titanate and barium titanate), when polarized, change their physical dimensions when subject to an electric field, usually applied through surface electrodes. Deflections of several angstroms per volt are typical. When the transducer is pulsed with a voltage, the deflection generates a pressure wave in an adjacent ink chamber, resulting in the ejection of a single drop, hence the name, "impulse" or "drop-on demand" printer. Often, arrays of these devices are integrated into a serial printhead which allows the printing of a one-character-high-per-head pass across the paper. Color printing can be accomplished by assigning one or more nozzles per color.

Only a very small (100–1000 Å) deflection of the piezoelectric transducer is needed to create the ink chamber pressure wave if the displacement is very rapid (10–100 $\mu$s). Hence, these devices are very efficient; only a few microjoules per drop are required for robust operation. Drop ejection rates of over 20 kHz have been demonstrated in the laboratory but commercial devices are typically designed for the 5–10 kHz range. Drops that produce a spot size of 150–200 $\mu$m on paper can be achieved with an orifice diameter of about 50 $\mu$m. Even greater device efficiency can be obtained by synchronizing the arrival of a direct wave and a reflected wave at the nozzle (e.g., a negatively reflected wave caused by an initial expansion pulse plus the direct wave from a following compression pulse). These two waves can be made to reinforce one another at the time and place of drop ejection.

Bubble-jet printing technology has also been called thermal-jet. With this approach, very small thermal resistors on the ink chamber wall are electrically pulsed. Joule heating of the resistor causes the temperature of the ink adjacent to the heater to rise to 350–400° C. Because the ink becomes locally superheated, nucleation of tiny bubbles takes place on the surface over the heater. These bubbles coalesce and very rapidly form a single expanding bubble which, by displacement (like a piston), propels a single drop of ink out of the orifice. The electrical pulse must be short (typically 3–6 $\mu$s) to insure low conductive heat losses; however, the power density is extremely high (~500

$MW/m^2$). The energy applied per drop is 30–50 $\mu$J but only a small fraction (a few percent) represents the kinetic energy of the drop. The remaining energy is thermally dissipated in the ink and device structure.

When the thermal energy in the superheated layer is depleted, the bubble begins to collapse. The total cycle (nucleation pulse bubble growth and collapse) is normally complete in about 20 $\mu$s. Drop rate, however, is typically limited to less than 10 kHz, mainly because of the limits of thermal dissipation. Cavitation damage can occur to the heater structure if the bubble collapse is too violent. Proper design of the ink chamber geometry can provide the necessary damping and minimize this problem. Heater element materials used for this technology include $HfB_2$, $ZrB_2$, $Ta_2Al$ and TaN. Passivation over-layers, e.g., SiC, $SiO_2$, $Si_3N_4$, plus certain metals such as tantalum, are deposited on top of the thin-film heaters to provide protection from chemical and mechanically enhanced corrosion. Materials, structures and thin-film deposition processes must be carefully designed to allow billions of heater pulse cycles without failure at a local power density of 500 $MW/m^2$.

Very low-cost, compact, low-power printers have been developed based on this technology because energy requirements are very low and the printhead can be made inexpensively using semiconductor-like planar processing techniques.

Commercial printers, both monochrome and color printers of all types are now available at modest cost and may be connected to a computer by conventional cabling using conventional communication protocol. The design may be scanned into the computer using a hand-operated or flat bed scanner, as are commercially available, or may be created on the computer itself using commercially available drawing and/or publishing software, for example, DRAW!mate™ software available from Stahls' Inc., St. Clair Shores, Mich. Photographs may be scanned or transferred to the computer from photo CD-ROM disks or the like, and the digitized image manipulated using Adobe Printshop™ or other commercial software. The creation of computer readable files corresponding to a desired design and the electronic inputting or transfer of such designs to printers is within the skill of the art.

The paper to be used as the transfer substrate may be ordinary copier paper, which is readily available. The paper may be coated, if desired, with a conventional release coating. Such coatings are well known, and include, for example, coatings of wax, silicone, or high melting non-adherent polymer, for example, polyethylene, polypropylene, and polyester. The amounts of such coatings are generally limited to a most minor amount, and are for the purpose of contributing to the ease of release of an applied coating from the substrate. In general, the release coating itself remains firmly attached to the substrate itself after the applied coating (design) has been removed. By the term "plain copy paper" is meant conventional white or colored paper intended for use in xerography or for general typing and business use. Alternatively, a high melting polymer film, for example Mylar® polyester, may be used as the substrate instead of paper.

The term "substantially free of fusible polymer" is meant to exclude heavily polymer coated papers which, when printed with a design and applied to an article with the aid of heat and pressure, will be transferred with the design, and in most cases, provide a significant quantity of adhesive polymer or fusible polymer which enables the design to adhere to the article. Such heavily polymer-coated substrates are known. It will be appreciated that it would not depart from the spirit of the invention to coat a plain paper or other substrate with a most minor amount of fusible polymer which in and of itself is incapable of adhering a transfer design to an article, and which does not significantly alter the ability of the design itself to adhere to an article. Nor would it depart from the spirit of the invention to employ a minor amount of polymer which is water-soluble and which would be readily removed from the article by washing. However, such polymers, even in minor quantities, are undesirable and unnecessary. Any amount of fusible polymer, even if present in minor amount, should not alter the hand or feel of the fabric in non-design-containing areas.

By the term "fusible polymer" is meant a polymer which will fuse at the temperature to which the article to be printed with the transfer is processed, or cure to a non-removable cured state. By "non-fusible polymer" is meant a polymer which may be applied to paper as a release coating or used as a transfer substrate, which is not significantly fusible at the temperature used to print the finished article with the transfer. Such non-fusible polymers will not coat or impregnate the finished printed article, and thus will not affect the hand or feel of textile material onto which the transfer is to be applied.

The ink to be utilized in the process of the subject invention may be a traditional transfer printing ink. Such inks, in general, contain a dye or finely divided pigmentary material and a fusible polymer, particularly a polyvinyl plastisol. The fusible polymer may be in solution, but is conventionally supplied in the form of an emulsion or dispersion. The inks are advantageously predominately aqueous, but may contain organic solvents, particularly low boiling solvents such as isopropanol or methylethylketone, or low molecular weight glycols or polyalkanols. The inks further advantageously contain dispersion stabilizers, viscosity adjusting agents, and the like. In the case of ink-jet printers, which rely on electrostatic deflection, a conductive substance must also be present.

The viscosity of the ink should be in a range suitable for use with ink-jet printers. The lower limit of viscosity is determined to some extent by the minimum amount of dye and/or pigment required to produce an image of suitable color saturation, and the amount of fusible polymer necessary to adhere the transfer to the article to be printed. Various rheology control agents may be used to modify the viscosity. For example, carboxymethyl cellulose, associative non-ionic thickeners, and long chain polyoxyethylene glycol and polyacrylic acid polymers may be added to increase viscosity, if needed. Such polymers may serve the further function of maintaining a stable dispersion. Low molecular weight surface active agents such as soaps, non-ionic surfactants, and the like may be added in small amounts to decrease viscosity. Various liquids including water and lower alkanols and ketones may be added to reduce ink viscosity as well.

Following application by the ink-jet printer to the transfer substrate and evaporation of solvent, the composition may have the characteristics of a hot melt ink, by virtue of the polymeric and/or waxy ingredients present along with the dye or pigment. The composition should be relatively tack-free and should melt at conventional transfer application temperatures, for example 300 to 400° F., more preferably 360 to 380° F., and most preferably 360 to 365° F. Selecting a suitable transfer temperature is within the level of skill in the art.

The liquid vehicle of the inks of the present invention may consist of water, or it may comprise a mixture of water and a miscible organic component, such as ethylene glycol, propylene glycol, diethylene glycol, glycerine, dipropylene glycol, polyethylene glycol, polypropylene glycol, amides, ethers, carboxylic acids, esters, alcohols, organosulfides, organosulfoxides, sulfones, alcohol derivatives, carbitol, butyl carbitol, cellusolve, ether derivatives, amino alcohols, ketones, and other water miscible materials, as well as mixtures thereof. When mixtures of water and water miscible organic liquids are selected as the liquid vehicle, the water to organic ratio may be in any effective range, and typically is from about 100:0 to about 30:70, preferably from about 97:3 to about 50:50. The non-water component of the liquid vehicle may be a humectant which has a boiling point higher than that of water (100° C.). In the inks of the present invention, the liquid vehicle is generally present in an amount of from about 50 to about 99.5 percent by weight, preferably 85 to about 99.5 percent by weight, and more preferably from about 90 to about 99 percent by weight.

Polyvinyl plastisol inks commonly used for screen printing are suitable for use herein. Depending on the printer technology utilized, such inks may have to be thinned to reduce viscosity or have a viscosity-reducing surfactant added. Preferred thinners are water and low boiling organic solvents, preferably the former. For printer technologies requiring the ink to be electrically conductive, minor amounts of conductive substances such as common alkali metal salts or quaternary ammonium compounds or other conductive substances may be added. Polyurethane dispersions are also suitable. Many such dispersions are available at high solids concentration and low viscosity, and may be pigmented by addition of a minor amount of colored pigment. Suitability of a given ink for the subject process may be readily ascertained by incorporating the ink into an ink cartridge suitable for the particular printer, printing a computer-generated design onto plain or release-coated paper or other substrate, and thermally transferring the design to a fabric article, followed by peeling away the substrate. If the color and image intensity are suitable, then the ink is suitable for use.

The preferred dye colorants for the inks of the present invention are oil soluble dyes or alcohol soluble dyes. These dyes generally exhibit substantial solubility in organic liquids such as oils or alcohols but exhibit little or no solubility in water. Preferred dyes typically have water solubilities of from 0 to about 10 grams of dye per liter of water, and preferably have water solubilities of less than 1 gram of dye per liter of water. The colorant for the inks of the present invention can be a dye or mixture of dyes. The dye or mixture of dyes is present in any effective amount. Typically, the total amount of dye in the ink compositions of the present invention is from about 0.5 to about 10 percent by weight, preferably from about 2 to about 5 percent by weight, although the amount can be outside of these ranges.

Examples of suitable dyes include all Sudan dyes available from BASF, such as Sudan Blue 670 (C.I. Solvent Blue 35, 61554, an anthraquinone dye with a solubility in water of less than 1 gram of dye per liter of water at 20° C.), Sudan Black X60 (C.I. Solvent Black 3, 26150, an azo dye insoluble in water), Sudan Blue OS (a copper phthalocyanine dye insoluble in water), Sudan Orange 220 (C.I. Solvent Yellow 14, 12055, an azo dye insoluble in water); Oil Blue N (C.I. Solvent Blue 14, 61555, insoluble in water, available from Aldrich Chemical Company, Inc.), Oil Brown 102 (C.I. Solvent Red 2, insoluble in water, available from Passaic Color & Chemical Company), Oil Red 234 (C.I. Solvent Red 24, 26105, bisazo dye insoluble in water, available from Passaic Color & Chemical Company), Orasol Blue 2GLN (C.I. Solvent Blue 48, a copper phthalocyanine sulfamide insoluble in water, available from Ciba-Geigy), Oracet Pink RF (C.I. Pigment Red 181, 73360, a thioindigoid insoluble in water, available from Ciba-Geigy), Orasol Black RL (C.I. Solvent Black 29, a monoazo dye-chrome complex insoluble in water, available from Ciba-Geigy), Orasol Red G (C.I. Solvent Red 125, a co-complex dye insoluble in water, available from Ciba-Geigy), Orasol Yellow 2GLN (C.I. Solvent Yellow 88, a chrome complex insoluble in water, available from Ciba-Geigy), Savinyl Blue GLS (C.I. Solvent Blue 44, a phthalocyanine dye insoluble in water, available from Sandoz Chemicals), Savinyl Fire Red 3GLS PAT (C.I. Solvent Red 124, a cobalt metallized azo dye insoluble in water, available from Sandoz Chemicals), Savinyl Yellow RLS (C.I. Solvent Yellow 83:1, a chromium metallized azo dye insoluble in water), and the like as well as mixtures thereof. Non-soluble dyes (pigments) are preferred.

Preferred examples of waxes are microcrystalline wax, carnauba wax and paraffin wax. In addition, representative examples of waxes which can be used include various waxes such as Fischer-Tropsch wax, various low molecular weight polyethylene and partially modified waxes, fatty acid esters, amides, Japan wax, bees wax, whale wax, insect wax, wool wax, shellac wax, cadelilla wax, and petrolatum.

Examples of the resins which can be used include EVA, EEA, polyethylene, polystyrene, polypropylene, polybutene, petroleum resins, vinyl chloride resins, polyvinyl alcohol, vinylidene chloride resins, methacrylic resins, polyamide, polycarbonate, fluorine resins, polyvinyl formal, polyvinyl butyral, acetyl cellulose, nitrocellulose, vinyl acetate resins, polyisobutylene and polyacetal.

In order to impart good thermal conductivity and melt transferability to the ink layer, a thermal conductive material can be incorporated into the ink composition. Such materials include carbonaceous materials such as carbon black, and metallic powders such as aluminum, copper, tin oxide and molybdenum disulfide. Use of such materials should preferably be minimized in ink destined for bubble jet printers.

Other additives can also be present in the inks of the present invention. For example, one or more surfactants or wetting or dispersion agents can be added to the ink. These additives may be of the cationic, anionic, or nonionic types. Suitable surfactants and wetting or dispersing agents include Tamol® SN, Tamol® LG, those of the Triton® series available from Rohm and Hass Company, those of the Marasperse® series, those of the Igepal® series available from GAF Company, those of the Tergitol® series, Strodex PK-90, available from the GAF, Pluronic F-68, available from BASF, Karasperse TU, available from Marasperse, and other commercially available surfactants. These surfactants and wetting agents are present in any effective amounts, generally from 0 to about 15 percent by weight, and preferably from about 0.01 to about 8 percent by weight.

Polymeric additives or dispersants can also be added to the inks of the present invention to enhance the viscosity of the ink. Examples include water soluble polymers such as Gum Arabic, polyacrylate salts, polymethacrylate salts, polyvinyl alcohols, hydroxypropylcellulose, hydroxyethylcellulose, polyvinylpyrrolidinone, polyvinylether, starch, polyethylene oxide, polysaccharides, sodium salt of naphthalene sulfonate formaldehyde copolymer, sodium salt of alkylbenzene sulfonate, sodium salt of dialkylsulfosuccinate, sodium salt of lignosulfonate, sodium alkylene oxide copolymer, sodium salt of alkyletherphosphate, and the like. In addition, polymers such as hydroxypropylpolyethyleneimine (HPPEI-200) or other polyethyleneimine derivatives can be added to the ink. Polymeric additives can be present in the ink of the present invention in any effective amount, typically from 0 to about 10 percent by weight, and preferably from about 0.01 to about 5 percent by weight.

Other optional additives to the inks of the present invention include humectants such as ethylene glycol, diethylene glycol, N-methylpyrrolidinone, propylene glycol, hydroxyethers, ethers, amides, sulfoxides, ketones, lactones, esters, alcohols, and the like, present in an amount of from 0 to about 50 percent by weight, and preferably from about 5 to about 40 percent by weight, pH controlling agents such as acids or bases, phosphate salts, carboxylate salts, sulfite salts, amine salts, and the like, present in an amount of from 0 to about 10 percent by weight and preferably from about 0.01 to about 2 percent by weight.

Suitable pigments include both organic pigments as well as inorganic pigments. The organic pigments are manufactured by the same technology utilized for synthetic dyestuff manufacture, but are highly insoluble rather than water, oil, or alcohol soluble. Such organic pigments are well known to those skilled in the art. Inorganic pigments include carbon black, titanium dioxide, iron oxide, ultramarine, and the like. The particle size of the pigments must be small enough to pass through the ink-jet printer ink nozzle without causing blockage.

With reference to FIG. 1, a computer-readable file in computer 1 corresponds to the desired graphic 2 and is communicated to printer 3 over cable 4. Printer 3 is an ink-jet printer containing color print cartridges 5, 6 and 7, each containing a different color of ink containing a fusible polymer, in solution, as a dispersion or emulsion, or as a sol. Paper carrier 8 contains plain copy paper 9. The paper 10 containing the printed design exits from the printer on the paper-out tray 11.

Figure 2:
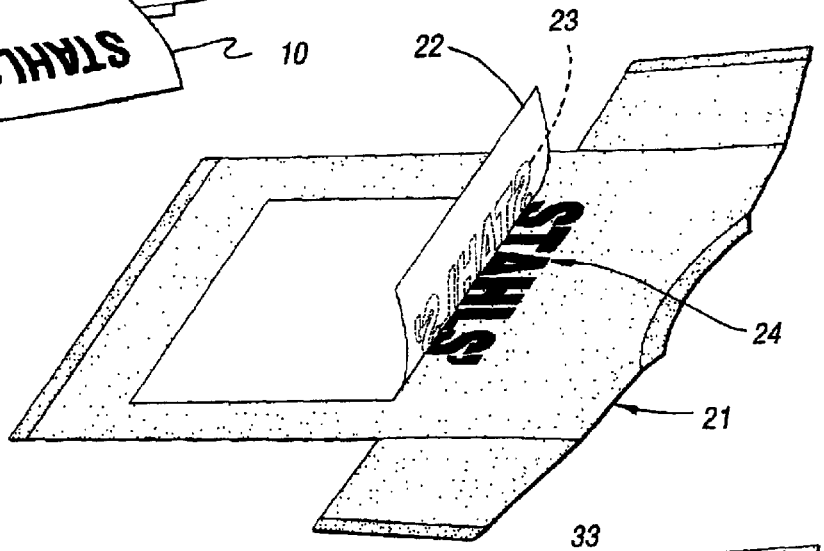
FIG. 2 illustrates the process of thermally transferring the subject invention transfer to a fabric article.

FIG. 2 illustrates transfer of the design to a fabric garment, in this case a T-shirt 21. The substrate 22 containing printed design 23 (shown in shadow) is pressed onto the T-shirt 21 in a heated press (not shown), and the substrate peeled away. The design 23 has been transferred to the T-shirt at 24.

Figure 3:
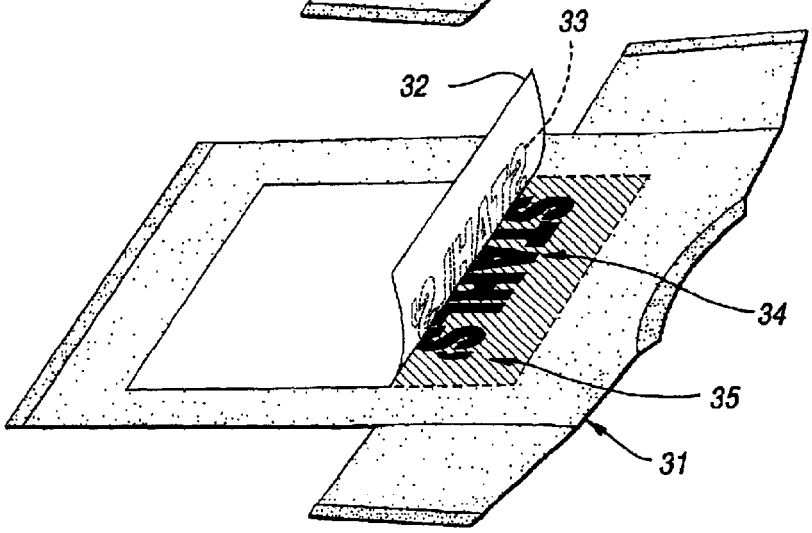
FIG. 3 illustrates the prior art process of transferring a design to a fabric article where a fusible polymer paper coating bonds the design to the fabric but is also transferred in non-design areas.

A prior art transfer is shown in FIG. 3. Substrate 32, a fusible polymer-coated paper, has had design 33 printed thereon. The substrate/design is placed on T-shirt 31 and pressed onto the shirt in a heated press. The design is transferred at 34. However, surrounding the transferred design is an area of transparent or translucent polymer 35 derived from the non-printed area of the paper. This fusible polymer causes the hand and feel of the garment to be altered over the area 35.

EXAMPLE 1

A transfer is prepared using a Epson Stylus 1200 ink-jet printer and plain copy paper. The ink-jet printer cartridge cover is sawed off and the cartridge thoroughly washed. The cartridge is refilled with a standard silk screen transfer ink designated Multi-Purpose 700 Series Nylon SS ink designated as LF and manufactured by International Coatings Company, Cerritos, Calif., a polyvinyl plastisol screen printing ink. The ink is first thinned to a viscosity similar to the ink in the ink-jet print cartridge. A computer generated image is transferred electronically by standard computer/printer communication protocol to the ink-jet printer to generate the transfer. The transfer is then placed on top of a poly/cotton fabric and heated in a standard transfer press at 365° F. for 20 seconds. The fabric retains the image from the transfer, but the hand and feel of the fabric is unaffected in the non-image areas, due to lack of any non-image polymer transfer from the paper.

Having now fully described the invention, it will be apparent to one of ordinary skill in the art that many changes and modifications can be made thereto without departing from the spirit or scope of the invention as set forth herein.

What is claimed is:

1. A transfer containing a computer generated graphics image suitable for transfer onto a fabric garment by application of heat and pressure, said transfer comprising:

(a) a planar substrate, optionally coated with a non-fusible release coating, and free of fusible polymer;

(b) a graphics image consisting essentially of particles of a dried fusible polymer ink, said graphics image printed onto said substrate by means of an inkjet printer containing at least one inkjet cartridge containing particles of said fusible polymer ink, said printer controlled by a computer-readable graphics file input to said printer, said graphics image printed onto one surface of said substrate, said transfer containing no fusible polymer other than the fusible polymer of said fusible polymer ink, said transfer suitable for forming on said fabric garment a graphics image, wherein said fabric has the same hand and feel after printing as before printing in areas outside the graphics image.

2. The transfer of claim 1, wherein said substrate comprises paper with no polymeric coating.

3. The transfer of claim 1, wherein said substrate comprises a plastic film.

4. The transfer of claim 1, wherein said substrate is paper, and said optional non-fusible release coating is present.

5. The transfer of claim 1, wherein said fusable polymer ink comprises a vinyl plastisol ink.

* * * * *